United States Patent [19]

Swearingen

[11] Patent Number: 5,045,711

[45] Date of Patent: Sep. 3, 1991

[54] TURBOEXPANDER-GENERATOR

[75] Inventor: Judson S. Swearingen, Glendora, Calif.

[73] Assignee: Rotoflow Corporation, Gardena, Calif.

[21] Appl. No.: 396,866

[22] Filed: Aug. 21, 1989

[51] Int. Cl.[5] ..... F01D 25/20; H02K 7/18

[52] U.S. Cl. ..... 290/52; 415/163

[58] Field of Search ..... 290/52; 415/147, 148, 415/150, 163, 164, 913

[56] References Cited

U.S. PATENT DOCUMENTS

| | | | |
|---|---|---|---|
| 2,804,021 | 8/1957 | Swearingen | 103/87 |
| 3,232,581 | 2/1966 | Swearingen | 253/122 |
| 3,495,921 | 2/1970 | Swearingen | 415/163 |
| 3,898,016 | 8/1975 | Kanger | 415/163 |
| 3,920,351 | 11/1975 | Grubb | 415/163 |
| 4,188,546 | 2/1980 | Kossler | 290/52 |
| 4,362,020 | 12/1982 | Meacher et al. | 290/52 X |
| 4,446,377 | 5/1984 | Kure-Jensen et al. | 290/52 |

*Primary Examiner*—A. D. Pellinen

*Assistant Examiner*—W. E. Duncanson, Jr.

*Attorney, Agent, or Firm*—Lyon & Lyon

[57] ABSTRACT

A turboexpander-generator system employing a housing with a rotatably mounted shaft oriented vertically with a turboexpander associated with the upper end of the housing and shaft, a generator associated with the housing and shaft below the turboexpander and a lubricant pump located at the lower end of the housing and shaft. The lubricant pump controls an actuator valve which controls the variable inlet nozzles to the turboexpander. Thus, a speed control system is achieved through use of the lubricant pump pressure. A seal gas separator is provided with two ports located in the turboexpander exducer at positions of different pressure. High pressure is used to provide a seal between the bearings and the turboexpander. Low pressure is directed to the area of the sump of the pump to enhance continuous lubricant return. A self-priming mechanism causes a reservoir to be charged during pump operation with return of the lubricant to the sump when the pump is off.

19 Claims, 1 Drawing Sheet

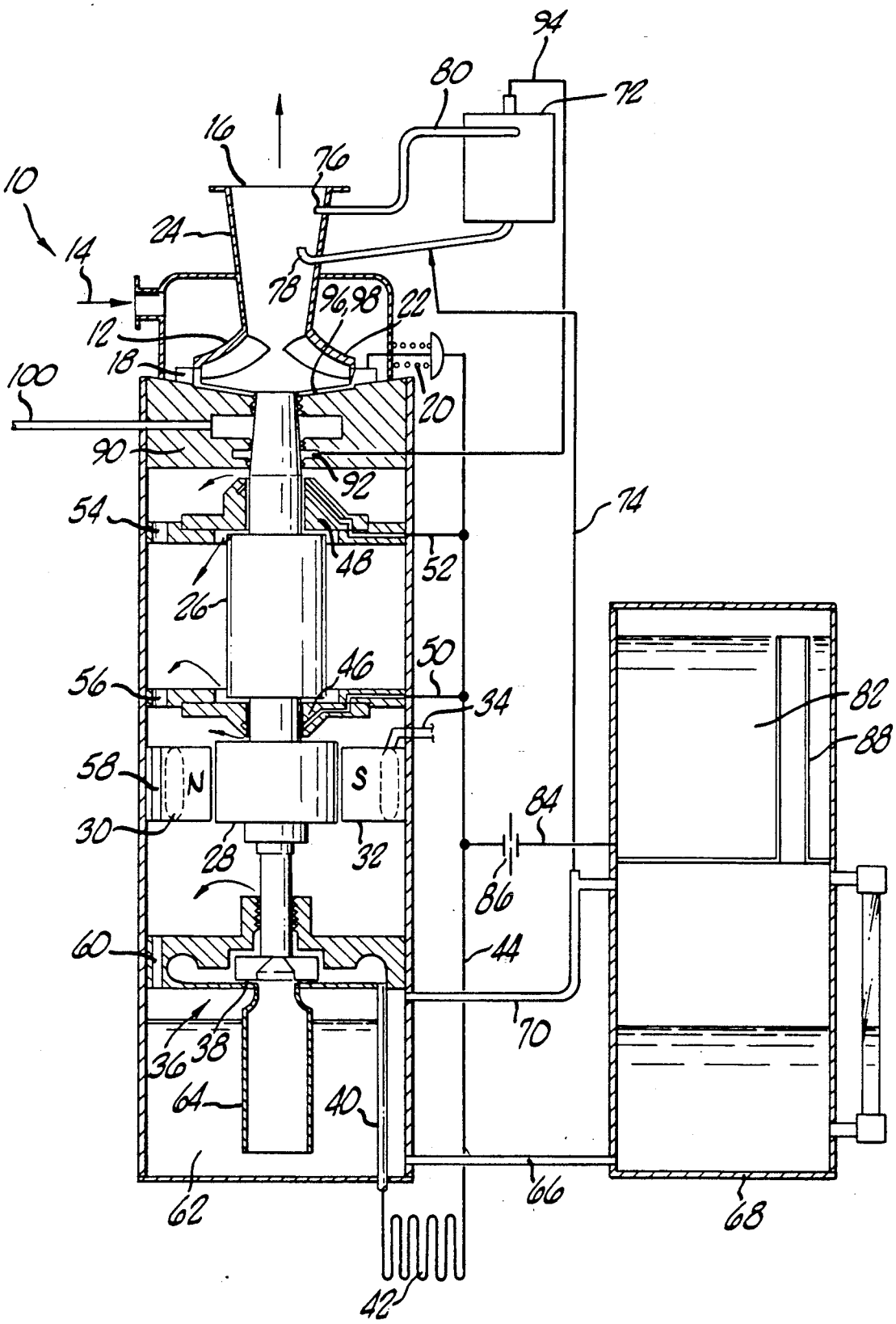
94
80
72
16
76
10
24
14
78
96,98
22
12
18
100
20
90
92
54
74
48
52
26
50
46
56
34
82
88
58
N
S
84
30
28
32
86
60
44
70
36
38
64
40
62
66
68
42

TURBOEXPANDER-GENERATOR

BACKGROUND OF THE INVENTION

The field of the present invention is turbo-machinery, and more specifically, small, self-contained turboexpanders.

Turbine driven electrical generators have been employed for the generation of electric power in remote locations and under circumstances where electric power is not available from other sources. On offshore platforms and other locations where a source of pressurized gas is available, such devices may be driven by this source of energy. These turbines in turn drive an electric generator as a source of local power. Such machinery tends to be complicated, requiring outside control, lubrication, and buffer gas systems. Maintenance requirements are often substantial; and such systems tend to be large. In remote locations such as oil fields and offshore platforms, excessive size, complicated mechanisms and significant maintenance can be disadvantages.

Turbines have also been developed which employ a lubricant pump mechanically driven by the shaft of the turbine rotor for internal lubrication. One such system is illustrated in U.S. Pat. No. 2,804,021. A lubricant pump is coupled on the same shaft as a turbine rotor with that pump lubricating bearings rotatably mounting the shaft. Pressure on the lubricant but for the output from the pump is controlled by leakage pressure from the working fluid in the turbine. The reservoir of lubricant provides a self priming function when the turbine and pump are not rotating.

SUMMARY OF THE INVENTION

The present invention is directed to turbo machinery which is mechanically uncomplicated and substantially self contained. A turboexpander is contemplated, which is associated with an electric generator to provide a self contained source of power for use in remote locations.

In a first aspect of the present invention, a turboexpander and generator arrangement having a compact and mechanically simple design is contemplated. A turbine is located above a generator on a common shaft. Speed control, internal lubrication and sealing may be self contained within the unit.

In another aspect of the present invention, speed control of a turboexpander is achieved through use of pressure from a lubricant pump. The pump is driven at speeds proportional to the turboexpander speeds. The outlet pressure of the pump may be employed to sense rotor speed and then be used to control an actuator associated with the variable inlet nozzles to the turboexpander.

In a further aspect of the present invention, pressure is regulated within the turboexpander system through the use of differential pressures in the turboexpander. Lines in communication with different positions within a conical exducer provide appropriate relative pressures for sealing purposes.

Accordingly, it is an object of the present invention to provide a turboexpander which is compact, substantially self-contained, and subject to low maintenance. The system is advantageous for use in remote locations such as offshore platforms requiring a compact, low maintenance system using pressurized gas, such as waste gas from a separator, for the generation of power.

Other and further objects and advantages will appear hereinafter.

BRIEF DESCRIPTION OF THE DRAWINGS

The FIGURE is a schematic cross-sectional elevation of a device of the present invention.

DETAILED DESCRIPTION OF THE PREFERRED EMBODIMENT

Turning in detail to the drawings, the FIGURE illustrates a turboexpander and generator, generally designated 10. This turboexpander and generator 10 includes a turboexpander 12 mounted on top of a housing 13. The turboexpander 12 includes a turbine housing 14 within which a rotor 15 is rotatably positioned. A source of gas, which may be at relatively low pressure, enters an inlet 16, is directed through variable inlet nozzles 17 and exits through an exducer 18. The variable inlet nozzles 17 are arranged and mounted such that they may be pivoted to vary the inlet area. Such a system is well known and illustrated in U.S. Pat. Nos. 3,232,581 and 3,495,921 which are incorporated herein by reference. The exducer 18 is preferably conical such that flow through the exducer decreases in velocity and increases in pressure as it progresses through the conical passage.

The variable inlet nozzles 17 are controlled by an actuator 20. The actuator 20, schematically illustrated in the FIGURE, includes a chamber 21, a diaphragm 22 located in the chamber 21 and a spring 23 which operates to bias the diaphragm in a first direction. The preload on the spring can be varied to vary the adjustment of the actuator. Thus, the variable inlet nozzles 17 can be controlled by changes in pressure against the diaphragm 22.

Fixed to the rotor 15 and rotatably mounted within the housing 13 is a shaft 26. The shaft 26 extends from a first end at the rotor 15 to mount an armature 28. The armature 28 may include a permanent magnet or other conventional device employed in a generator. Coils 30 in a stator 32 encircle the armature 28 to define a generator. Power is withdrawn from the generator through leads 34. In the event that a D C generator is desired, the power may be passed through an external rectifier, not shown. Through appropriate configuration of this generator, direct drive with the turboexpander may be achieved to enhance efficiency, compactness and reliability of the system.

Also, fixed to the shaft 26 at a second end thereof is a lubricant pump, generally designated 36. The pump 36 includes an impeller 38 within a volute leading to an outlet 40. The outlet 40 leads to a cooler coil 42 and distribution line 44. An inlet 45 is open to the impeller 38 from below.

Fixed within the housing 13 ar two bearings 46 and 48. These bearings mount the shaft 26 and preferably provide thrust as well as general support. Lubricant flows through the line 44 to branches 50 and 52 for distribution to the bearings 46 and 48, respectively. The lubricant flowing through the bearings is then discharged as illustrated by the arrows from either end of each. Drainage holes 54, 56, 58 and 60 are provided in the bearing supports in the housing 13, the stator 32 and the pump body 36 to allow lubricant recirculation back to a sump 62 located in the bottom end of the housing 13.

The line 44 from the pump 36 also extends to the chamber 21 of the actuator 20. With increasing speed of the turbine, generator and pump, all fixed to rotate together on the shaft 26, increasing pressure is directed to the actuator 20. This results in an adjustment to the variable inlet nozzle 17 to reduce the power of the turboexpander 12 if the rotational speed is above nominal. Naturally, the converse is true when rotational speed drops below nominal. The lubricant pressure exiting from the pump 36 varies as the square of the speed of the shaft 26. The actuator 20 and variable inlet nozzle 17 are thus configured to respond in a stable manner.

Associated with the sump 62 is a suction line 64 directed to the inlet 45 of the lubricant pump 36. Under normal operation, the level of lubricant in the sump 62 is below that of the pump 36. A line 66 couples a reserve reservoir 68 with the sump 62 to provide increased lubricant capacity. A sight gauge 69 indicates lubricant level. An equalizer tube 70 also communicates the sump 62 with the reservoir 68. During operation, the tube 70 is above the lubricant level in each of the sump 62 and the reservoir 68.

A seal gas separator 72 defining a chamber conveniently adjacent the exducer 18 includes pressure regulation through ports 76 and 78 in the exducer 18. A high pressure line 80 extends between the separator 72 and the port 76. The line 80 is in communication with the chamber of the separator 72 toward its upper end. A low pressure line 81 communicates with the low pressure port 78 and with the bottom of the chamber of the separator 72. As velocity is reduced in the exducer 18 through the diverging conical passage, pressure increases. Thus, the pressure at the port 76 is higher than the pressure at the port 78. Consequently, flow is induced through the separator 72 with the exhausted gases from the turboexpander 12 moving through the line 80 into the separator and through the line 81 from the separator. The location of the line 81 allows entrained liquids and other material to drain from the chamber of the separator 72 back into the exhaust of the turboexpander 12 through the port 78. The lines 80 and 81 are sized or configured such that the pressure within the separator 72 is substantially regulated by the pressure at the port 76 rather than at the port 78. Thus, a supply of differential pressure is provided by the separator 72. The equalizer tube 70 is coupled to the low pressure line 81 by means of a line 82. This provides a first pressure to the sump 62 and the reservoir 68.

Also, coupled with the line 44 from the discharge of pump 36 is a line 84. The line 84 is coupled with the lubricant tank 85 conveniently positioned on the reservoir 68. An orifice 86 controls flow through line 84. The lubricant tank 85 has an overflow tube 88 which regulates the level of lubricant within the tank 85. The overflow tube 88 returns lubricant to the reservoir 68. During operation of the pump 36, lubricant flows through the line 44 under pressure. Consequently, the lubricant tank 85 is slowly filled through the line 84 as controlled by the orifice 86. When the pump 36 is shut off, lubricant will flow in the reverse direction from the tank 85 through the orifice 86 back into the sump 62. This raises the level of lubricant in the sump 62 such that the pump 36 is automatically primed. Once the pump has been started, lubricant again flows through the orifice 86 into the tank 85.

Located between the turboexpander 12 and the upper bearing 48 is a seal structure 90. The shaft 26 extends through a passageway in the structure 90 which contains a labyrinth seal 91. It is advantageous that gases from the rotor chamber do not flow downwardly toward the bearing 48. This can cause contamination of the lubricant. It is also preferred that gases with lubricant entrained therein do not flow upwardly through the labyrinth seal 91 as this would result in a continual loss of lubricant. An annular chamber 92 is positioned in the seal structure 90 about the shaft 26. This chamber 92 is coupled by means of a line 94 to the seal gas separator 72 at its upper end.

Because the separator 72 is maintained at a pressure dependent on the pressure at port 76, seal gas flows through the passage 94 into the chamber 92. The gas may then flow in either direction along the labyrinth seal 91 to form a barrier. The line 94 is in communication with the separator 72 at its upper end in order to provide the cleanest possible seal gas from the separator 72. Located between the annular chamber 92 and the rotor chamber is a second annular chamber and exhaust line 100. This may be directed to atmosphere to receive and discharge seal gas 92 and gases from the rotor chamber. Thus, a complete sealing is provided by these annular chambers. The seal gas pressure in the annular chamber 92 is arranged to be higher than the pressure in the sump 62. This is accomplished by the differential pressure provided by the seal gas separator arrangement. As described above, the pressure through line 82 is more dependent on the pressure at the port 78 and the pressure in the chamber 92 is more dependent on the pressure at the port 76. Thus, a pressure differential assists flow of the lubricant, once discharged from the bearings, back to the sump 62.

Accordingly, a self contained turboexpander generator has been disclosed finding particular utility for the generation of electricity where pressurized gases are readily available such as on offshore platforms. While embodiments and applications of this invention have been shown and described, is would be apparent to those skilled in the art that many more modifications are possible without departing from the inventive concepts herein. The invention, therefore, is not to be restricted except in the spirit of the appended claims.

What is claimed is:

1. A turboexpander comprising a rotatably mounted drive train including a vertical shaft;

a turbine including a rotor affixed to said drive train at the upper end of said shaft;

variable inlet nozzles communicating with the periphery of said rotor;

a lubricant pump fixed to said drive train at the lower end of said shaft;

an actuator coupled to said variable inlet nozzles to selectively open and close said nozzles and hydraulically coupled to the outlet of said lubricant pump to control said actuator by the pressure of the outlet of said lubricant pump.

2. The turboexpander of claim 1 wherein said pump is a centrifugal pump.

3. The turboexpander of claim 1 further comprising a generator coupled to said shaft.

4. The turboexpander of claim 1 wherein said rotor is a radial reaction type.

5. A turboexpander comprising a rotatably mounted drive train;

a turbine including a rotor affixed to said drive train;

variable inlet nozzles communicating with the periphery of said rotor;

a lubricant pump fixed to said drive train;

an actuator coupled to said variable inlet nozzles to selectively open and close said nozzles and hydraulically coupled to the outlet of said lubricant pump to control said actuator by the pressure of the outlet of said lubricant pump, including a chamber coupled to said lubricant pump and a diaphragm in said chamber actuated by the pressure of the outlet of said lubricant pump.

6. The turboexpander of claim 5 wherein said actuator further includes an adjustable spring biasing said diaphragm in a first direction.

7. A turboexpander comprising a rotatably mounted shaft;

a turbine rotor affixed to said shaft;

a conical exducer extending from said turbine rotor;

a seal about said shaft and having an annular cavity therein;

a seal gas chamber;

a high pressure line extending between and in communication with both said exducer and said chamber;

a low pressure line extending between and in communication with both said exducer and said chamber, said low pressure line being in communication with said exducer in an area of smaller cross section than said high pressure line;

a seal gas line in communication with said chamber and said annular cavity.

8. The turboexpander of claim 7 wherein said low pressure line communicates with said chamber at the bottom thereof and said seal gas line communicates with said chamber at the top thereof.

9. The turboexpander of claim 7 wherein said high pressure line and said low pressure line are constructed and arranged such that said chamber is maintained at near the pressure of said high pressure line.

10. The turboexpander of claim 7 further comprising a lubricant pump driven by said shaft and having a sump in communication with the inlet of said lubricant pump, said low pressure line being in communication with said sump.

11. A turboexpander comprising a rotatably mounted shaft;

a turbine rotor affixed to said shaft;

a conical exducer extending from said turbine rotor;

a seal about said shaft and having an annular cavity therein;.

a seal gas chamber;

a high pressure line extending between and in communication with both said exducer and said chamber;

a low pressure line extending between and in communication with both said exducer and said chamber, said low pressure line being in communication with said exducer in an area of smaller cross section than said high pressure line;

a seal gas line in communication with said chamber and said annular cavity;

variable inlet nozzles communicating with the periphery of said rotor;

a lubricant pump fixed to said drive train;

an actuator coupled to said variable inlet nozzles to selectively open and close said nozzles and hydraulically coupled to the outlet of said lubricant pump to control said actuator by the pressure of the outlet of said lubricant pump.

12. The turboexpander of claim 11 wherein said lubricant pump includes a sump in communication with the inlet of said lubricant pump, said low pressure line being in communication with said sump.

13. An electric generator comprising a housing;

a shaft rotatably mounted in said housing, said housing including a seal having an annular cavity therein about said shaft;

a turboexpander affixed to aid housing and including a rotor affixed to said shaft, a variable inlet and a conical exducer extending from said turbine rotor;

a generator affixed to said housing and having an armature affixed to said shaft;

bearings positioned in said housing, said shaft being rotatably mounted in said bearings;

a pump positioned in said housing and including an impeller affixed to said shaft, the output of said pump being directed to said bearings;

an actuator controlling said variable inlet responsive to output pressure of said pump;

a seal gas chamber;

a high pressure line extending between and in communication with both said exducer and said chamber;

a low pressure line extending between and in communication with both said exducer and said chamber, said low pressure line being in communication with said exducer in an area of smaller cross section than said high pressure line;

a seal gas line in communication with chamber and said annular cavity.

14. The electric generator of claim 13 wherein said variable inlet includes variable inlet nozzles communicating with the periphery of said rotor and said actuator is coupled to said variable inlet nozzles to selectively open and close said nozzles and is hydraulically coupled to the outlet of said pump.

15. The electric generator of claim 13 wherein said housing further includes a sump in communication with the inlet of said lubricant pump, said low pressure line being in communication with said sump.

16. An electric generator comprising a housing including a seal having an annular cavity therein;

a shaft rotatably mounted in said housing with said annular cavity about said shaft;

a turboexpander affixed to said housing and including a rotor affixed to said shaft and variable inlet nozzles communicating with the periphery of said rotor;

a generator affixed to said housing and having an armature affixed to said shaft;

bearings positioned in said housing, said shaft being rotatably mounted in said bearings;

a pump positioned in said housing and including an impeller affixed to said shaft, the output of said pump being directed to said bearings;

an actuator coupled to said variable inlet nozzles to selectively open and close said nozzles and hydraulically coupled to the outlet of said pump to control said actuator by the pressure of the outlet of said pump;

a conical exducer extending from said turboexpander;

a seal gas chamber;

a high pressure line extending between and in communication with both said exducer and said chamber;

a low pressure line extending between and in communication with both said exducer and said chamber, said low pressure line being in communication with said exducer in an area of smaller cross section than said high pressure line;

a seal gas line in communication with said chamber and said annular cavity.

17. The electric generator of claim 16 wherein said housing further includes a sump in communication with the inlet of said lubricant pump, said low pressure line being in communication with said sump.

18. The electric generator of claim 16 wherein said high pressure line and said low pressure line are constructed and arranged such that said chamber is maintained at near the pressure of said high pressure line.

19. The electric generator of claim 18 wherein said low pressure line communicates with said chamber at the bottom thereof and said seal gas line communicates with said chamber at the top thereof.

* * * * *